US008245655B2

(12) United States Patent
Kawaguchi et al.

(10) Patent No.: US 8,245,655 B2
(45) Date of Patent: Aug. 21, 2012

(54) CAP FRAME FOR USE WITH EMBROIDERY SEWING MACHINE

(75) Inventors: Yasuhiko Kawaguchi, Nagoya (JP); Junnosuke Matsuda, Nagoya (JP); Takahira Osamura, Kitanagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 12/965,240

(22) Filed: Dec. 10, 2010

(65) Prior Publication Data

US 2011/0155032 A1 Jun. 30, 2011

(30) Foreign Application Priority Data

Dec. 25, 2009 (JP) ..... 2009-294807

(51) Int. Cl.
*D05C 7/04* (2006.01)

(52) U.S. Cl. ..... 112/103

(58) Field of Classification Search ..... 112/103, 112/104, 114, 475.11, 470.13, 470.14; 101/127.1
See application file for complete search history.

(56) References Cited

U.S. PATENT DOCUMENTS 6,463,867 B2 * 10/2002 Kato ..... 112/103
7,080,602 B2 7/2006 Kawaguchi et al.
7,100,523 B2 * 9/2006 Terao ..... 112/103

FOREIGN PATENT DOCUMENTS

JP A-11-93060 4/1999
JP A-2005-273095 10/2005

* cited by examiner

*Primary Examiner* — Tejash Patel
(74) *Attorney, Agent, or Firm* — Oliff & Berridge, PLC

(57) ABSTRACT

A cap frame includes an annular cap frame body detachably attachable to a feed mechanism of an embroidery sewing machine and holds a cap so that a predetermined part of the cap is embroidered. The cap frame further includes a pressing member which has a proximal end mounted on the cap frame body so that the pressing member is pivotally movable thereby to be switchable between a pressing position where the pressing member presses a vicinity of the predetermined part of the cap from outside and an open position where the pressing member allows the cap to be attached to or detached from the cap frame, and a guide member which guides the pressing member so that the pressing member is prevented from being caught on another member of the cap frame, when the pressing member is switched between the pressing position and the open position.

6 Claims, 9 Drawing Sheets

CAP FRAME FOR USE WITH EMBROIDERY SEWING MACHINE

CROSS-REFERENCE TO RELATED APPLICATIONS

This application is based upon and claims the benefit of priority from the prior Japanese Patent Application No. 2009-294807 filed on Dec. 25, 2009, the entire contents of which are incorporated herein by reference.

BACKGROUND

1. Technical Field

The present disclosure relates to a cap frame which holds a cap in order that embroidery may be sewn on a part of the cap to be embroidered by an embroidery sewing machine.

2. Related Art

There have conventionally been provided embroidery sewing machines which can sew embroidery on a front of a cap such as a baseball cap or a periphery of the cap. In these embroidery sewing machines, a cap is set on a cap frame, and the cap frame is detachably connected to a feeding mechanism, whereby embroidery can be sewn on the cap. Furthermore, when attaching or detaching a cap to or from the cap frame, a worker generally mounts the cap frame on a cap-frame setting frame fixed to a working table. The cap is then held by the cap frame or detached from the cap frame.

The aforesaid cap frame includes a cap frame body which is attached to the feeding mechanism of an embroidery sewing machine or to the cap-frame setting frame, and a pressing member having a proximal end supported by the cap frame body. The cap frame body is formed into a cylindrical shape and is provided with a flange. The flange has a function of increasing a rigidity of the cap frame body and a function of preventing displacement of the pressing member. The aforesaid pressing member comprises an elastic thin plate member and has a through-hole through which a visor of the cap is inserted.

When a cap is to be held by a cap frame, a cap frame body is firstly attached to a cap-frame setting frame. The cap is then set onto the cap frame body with the front side of the cap having a visor being directed upward. Subsequently, the visor of the cap is inserted through the through-hole of the pressing member while the pressing member is being pivotally moved about the proximal end thereof in such a direction that the cap is pressed by the pressing member. A hook member provided on a distal end of the pressing member is locked on the cap frame body side. As a result, the pressing member is disposed along the opening side of the cap and presses the vicinity of a part of the cap to be sewn from outside, by the elasticity thereof.

The aforesaid flange is provided on the cap frame so as to be adjacent to the pressing member in order to prevent the pressing member pressing the cap from being displaced. For this reason, the pressing member needs to be operated so as not to be displaced back and forth when the cap is to be pressed by the pressing member. Otherwise, the pressing member is caught on the flange or the like. More specifically, there is a possibility that the cap cannot be properly held if the pressing member, in pressing the cap, is flexed in the direction opposed to the direction in which the cap is pressed by the pressing member.

On the other hand, another conventional cap frame includes a pressing member made of an elastic material. The pressing member has an insertion hole for the visor and hangs downward from a proximal end thereof. When a cap is to be pressed, the visor of the cap is inserted through the insertion hole while the pressing member is attached round the cap frame body so that the cap is interposed between the cap frame body and the pressing member. A hook member on the distal end of the pressing member is locked on the cap frame body side. Accordingly, in this cap frame, too, the pressing member has a possibility of being caught on the flange unless the pressing member is twisted around the cap so as not to be displaced relative to the cap frame body.

In each above-described conventional cap frame, the pressing member needs to be attached along the flange while the visor of the cap is being inserted through the insertion hole of the pressing member. Thus, a work of holding the cap by an accurate operation of the pressing member is unexpectedly troublesome. The pressing member hanging downward needs to be lifted upward particularly in the latter conventional cap frame. Furthermore, the aforementioned holding work needs to be carried out while the pressing member is attached round the periphery of the cap frame body, whereupon the working efficiency is reduced.

SUMMARY

Therefore, an object of the disclosure is to provide a cap frame which can prevent the pressing member from being caught on another member of the cap frame, thereby improving the working efficiency.

The present disclosure provides a cap frame which includes an annular cap frame body detachably attachable to a feed mechanism of an embroidery sewing machine, the cap frame being configured to hold a cap so that a predetermined part of the cap is embroidered, the cap frame comprising a pressing member which has a proximal end mounted on the cap frame body so that the pressing member is pivotally movable thereby to be switchable between a pressing position where the pressing member is configured to press a predetermined part of the cap from outside and an open position where the pressing member allows the cap to be attached to or detached from the cap frame; and a guide member that is configured to guide the pressing member so that the pressing member is prevented from being caught on another member of the cap frame, when the pressing member is switched between the pressing position and the open position, wherein the cap frame body includes a flange which is adjacent to the pressing position and protrudes radially outward from the cap frame body; the guide member guides the pressing member so that the pressing member is prevented from being caught on the flange; and the guide member includes an inclined portion which is formed integrally with the flange and is inclined in such a direction that the pressing member is guided to the pressing position side, relative to a protruding direction of the flange.

DETAILED DESCRIPTION

Figure 1:
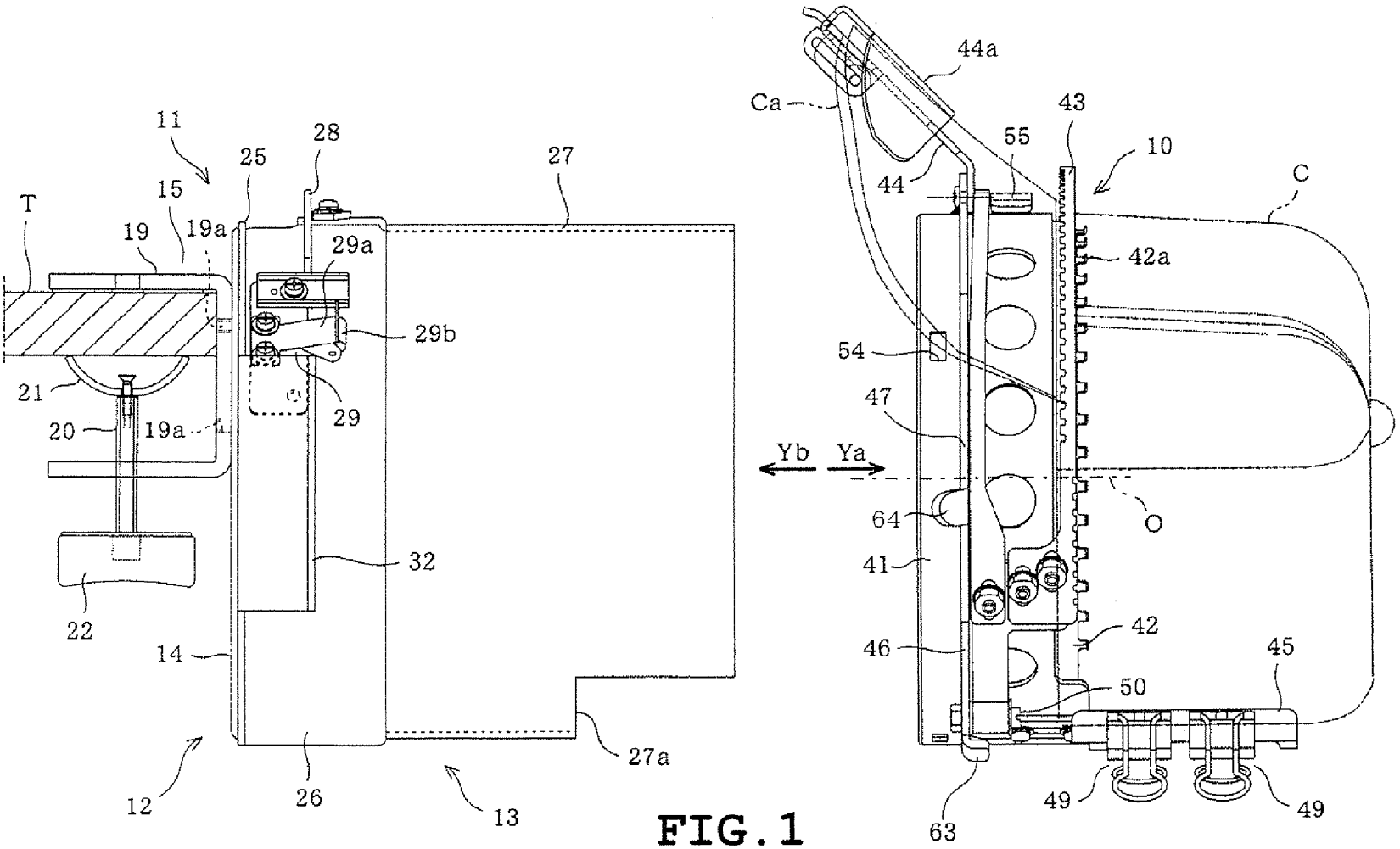
FIG. 1 is a side view of a cap frame according to a first embodiment, showing the state before the cap frame is attached to an embroidery-frame attachment setting frame.
Figure 2:
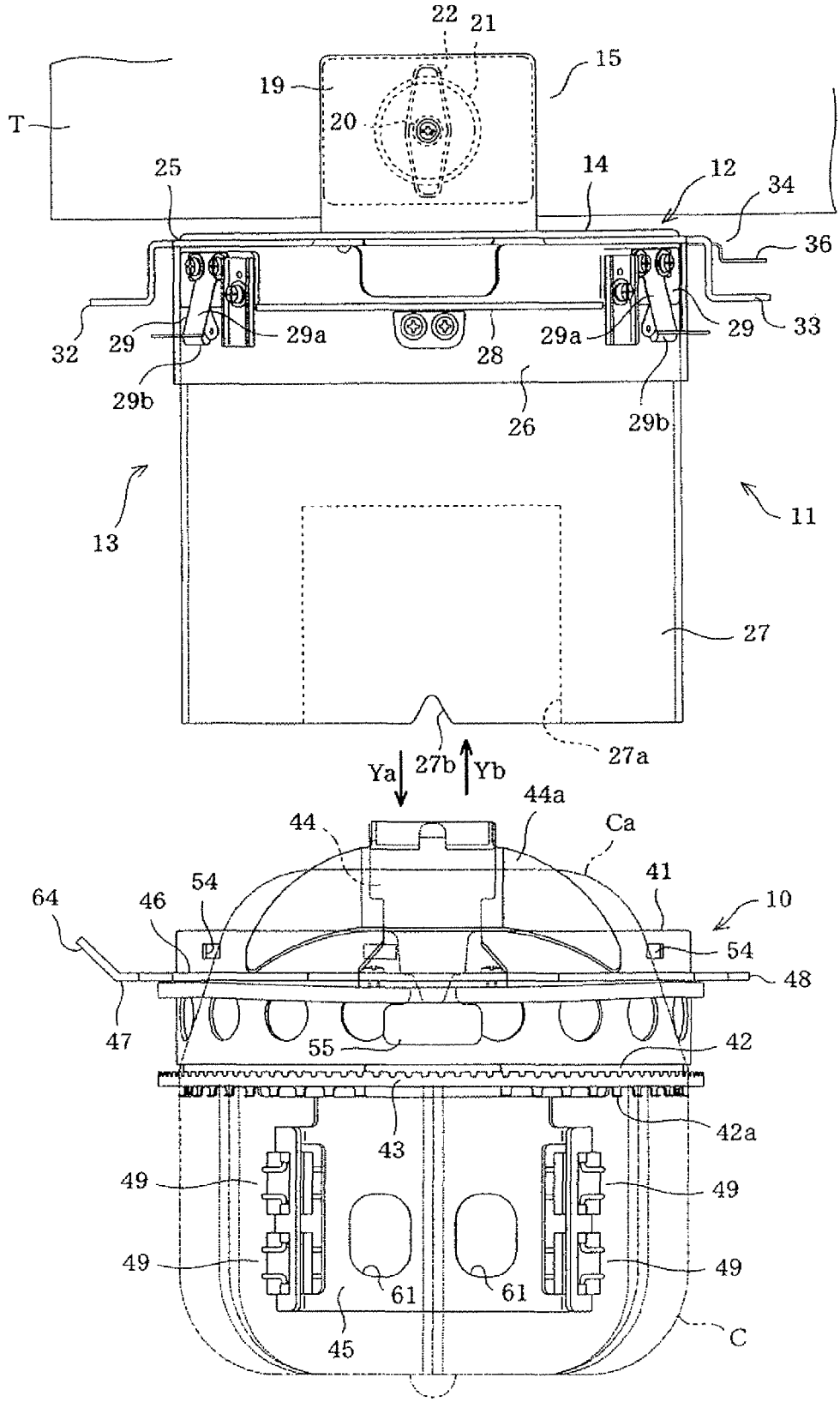
FIG. 2 is a plan view of the cap frame, showing the state before the cap frame is attached to the embroidery-frame attachment setting frame.
Figure 3:
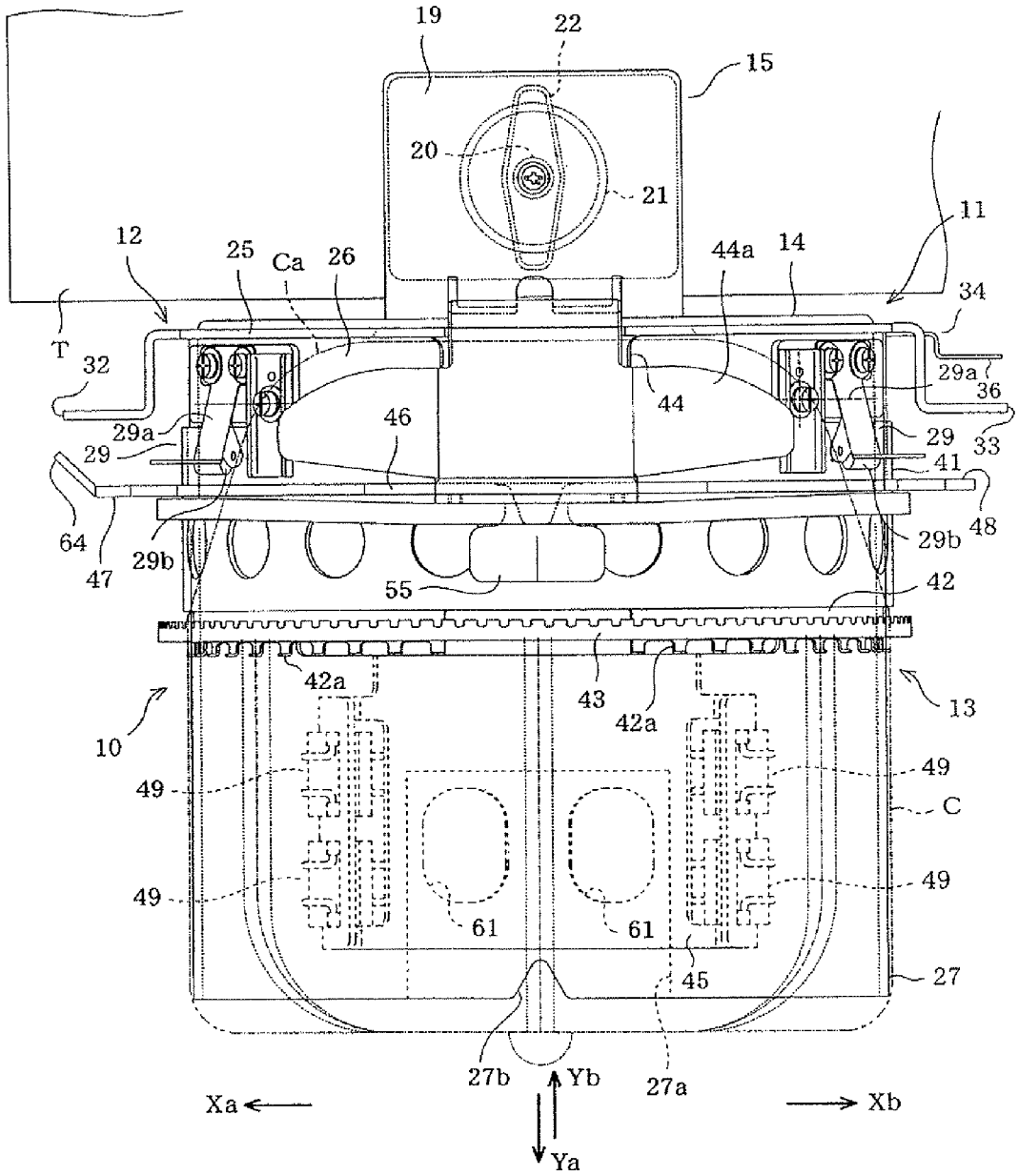
FIG. 3 is a plan view of the cap frame, showing the state after the cap frame has been attached to the embroidery-frame attachment setting frame.

A first embodiment will now be described with reference to FIGS. 1 to 8. The cap frame according to the first embodiment is applied to a multi-needle embroidery sewing machine. More specifically, the cap frame 10 is used to hold a cap C when embroidery is sewn on the cap C by the embroidery sewing machine. The cap C is a baseball cap, for example, and includes a front and a periphery thereof each serving as a part on which the embroidery is to be sewn, as shown in FIGS. 1 to 3.

The cap frame 10 is detachably attached to a cap-frame attachment setting frame 11 when the cap C is to be attached to the cap frame 10 by a user or an operator. In the following description, the side where the user is located in order to attach or detach the cap frame 10 to or from the setting frame 11 will be referred to as "front" and the side opposed to the front will be referred to as "rear." A front-rear direction will be referred to as "Y direction." The direction of arrow Ya refers to a direction in which the cap frame 10 is detached from the setting frame 11, that is, frontward, as shown in FIGS. 1 to 3. The direction of arrow Yb refers to a direction in which the cap frame 10 is attached to the setting frame 11, that is, rearward.

The embroidery sewing machine will firstly be described in brief although not shown in the drawings. The multi-needle embroidery sewing machine has a base and an arm extending frontward from an upper part of the base. The arm has a distal end on which a needle bar case having a plurality of needle bars is mounted. The needle bars have lower ends to which needles are attached respectively. Different colors of embroidery threads are to be set to the needles respectively. A needle-bar selecting drive mechanism is provided in the arm to select one of the needle bars in the needle-bar case thereby to vertically drive the selected needle bar. A cylinder bed is provided on the base so as to extend frontward and has a thread loop taker and the like.

Figure 5:
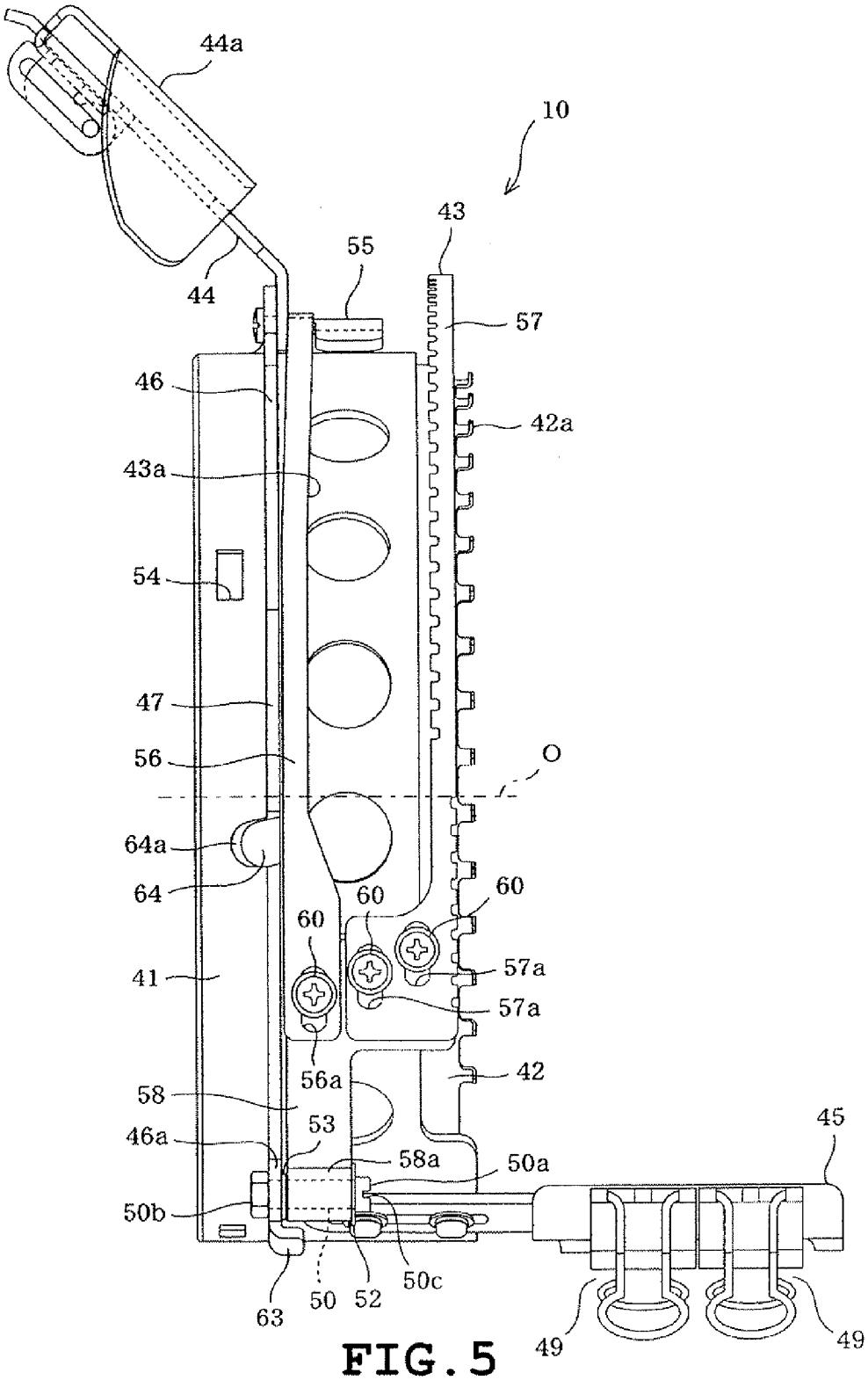
FIG. 5 is a left side view of the cap frame.
Figure 7:
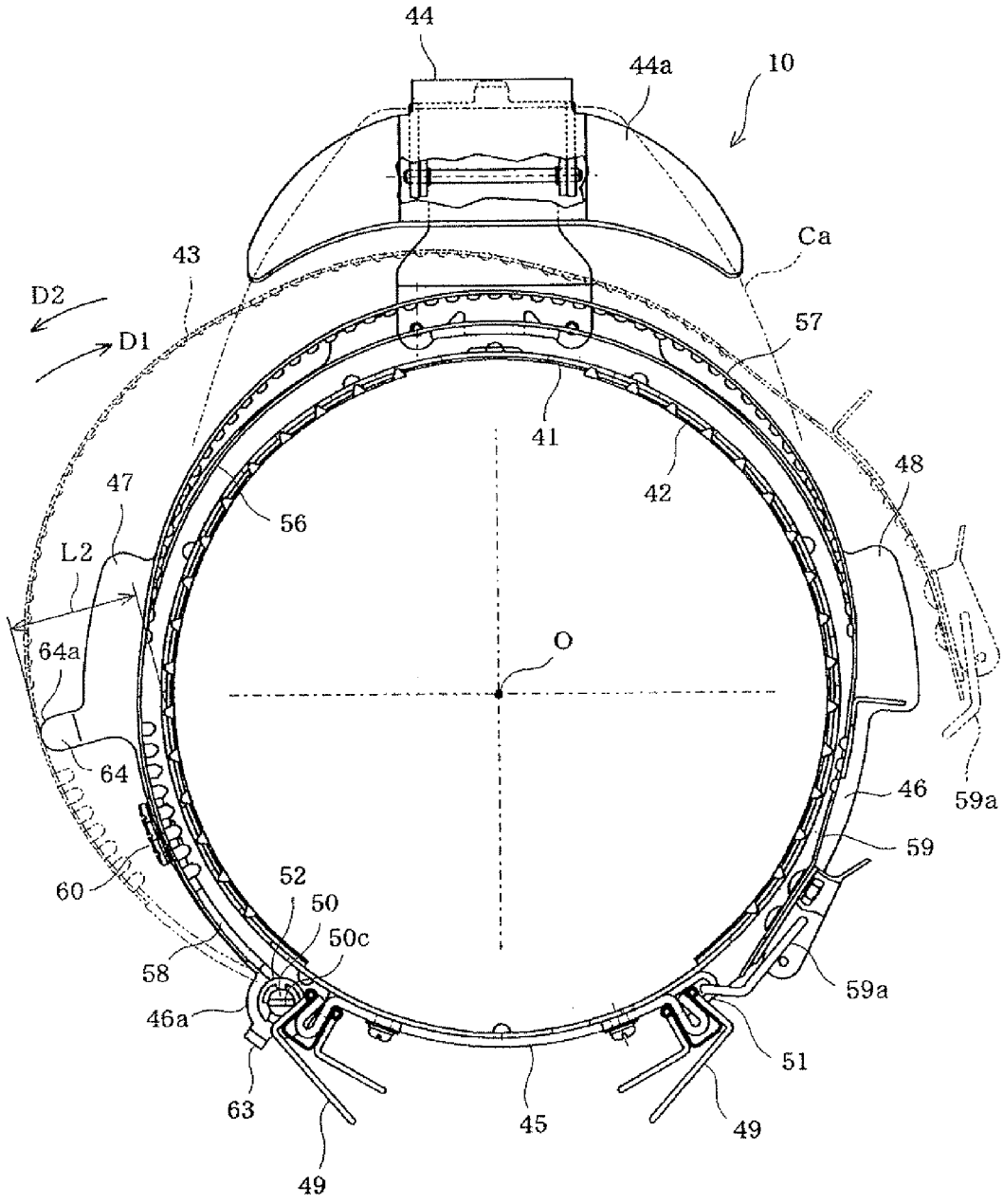
FIG. 7 is a front view of the cap frame.

A feed mechanism is also provided on the base. The feed mechanism includes a carriage to which is to be detachably connected a known embroidery frame which holds workpiece cloth in a horizontal state or the cap frame 10 which holds the cap C. The feed mechanism moves the embroidery frame in the Y direction or in the front-rear direction and in the X direction perpendicular to the Y direction or in the right-left direction. Furthermore, when the cap frame 10 is connected to the feed mechanism, the feed mechanism moves the cap frame 10 in the Y direction and pivotally moves the cap frame 10 about a central axis O as shown in FIGS. 1, 5 and 7. The central axis O corresponds with a central axis of the cap frame body as will be described later.

The cap-frame attachment setting frame 11 will now be described with reference to FIGS. 1 to 9. The setting frame 11 is used when the cap C is attached to or detached from the cap frame 10. The setting frame 11 includes a base frame 12 fixed to a predetermined work table T and a pivot frame 13 pivotally mounted at the distal end of the base frame 12. The cap frame 10 is attached to the pivot frame 13. FIGS. 1 to 3 show a part of a table serving as the work table T.

Figure 4:
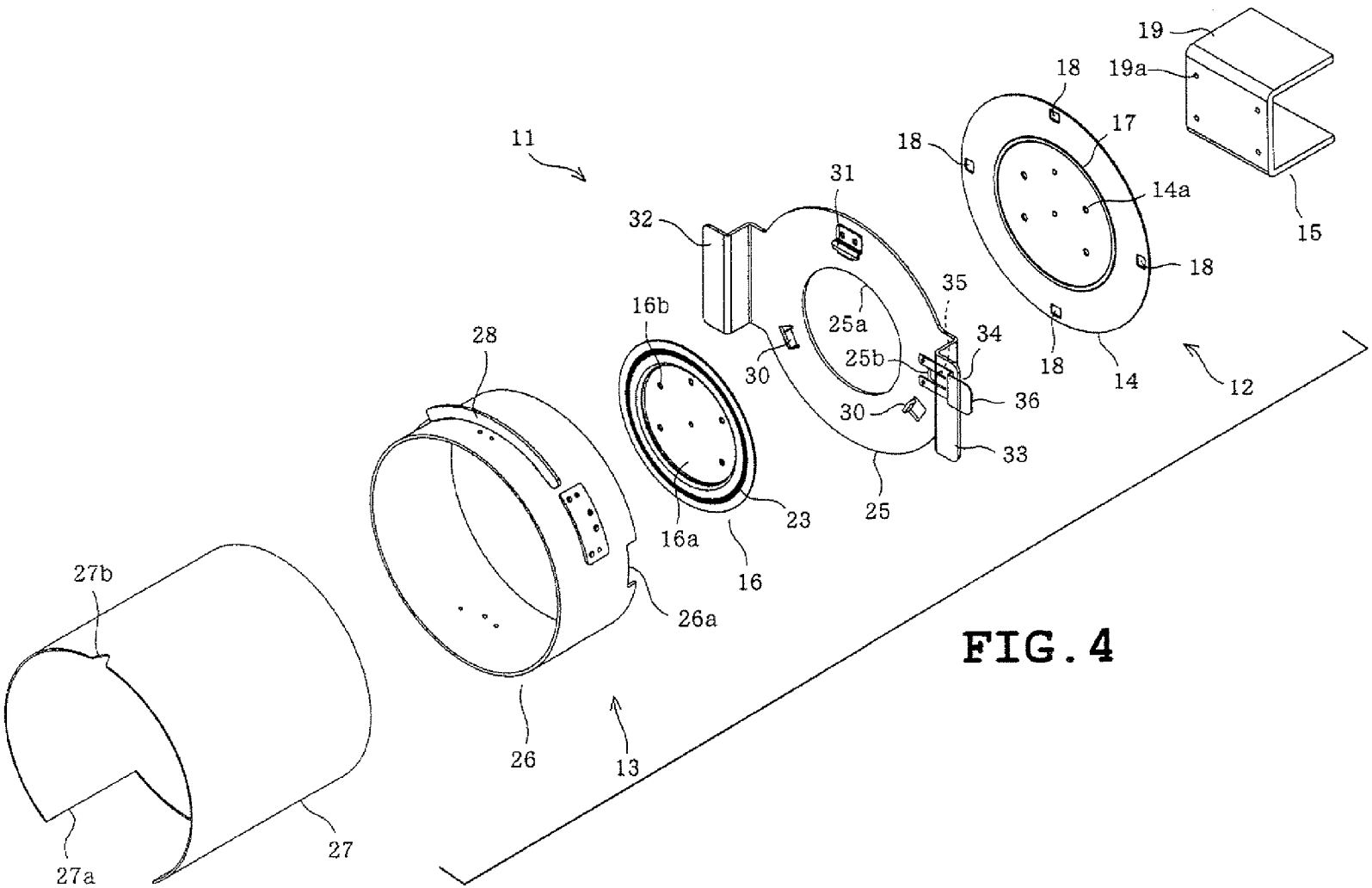
FIG. 4 is an exploded perspective view of the embroidery-frame attachment setting frame.

The base frame 12 includes a base plate 14, a fixing mechanism 15 provided at the rear side thereof and a disc-like supporting member 16 as shown in FIG. 4. The base plate 14, the fixing mechanism 15 and the supporting member 16 are screwed to one another thereby to be connected to one another. The base plate 14 is formed into the shape of a disc and has a frontwardly convex concentric annular protrusion 17 which is formed on a part thereof slightly near an outer circumference by a drawing process. The outer circumference of the base plate 14 is formed with four locking holes 18 spaced at intervals of 90 degrees. Four screwing holes 14*a* are formed in a region inside the protrusion 17 of the base plate 14.

The fixing mechanism 15 includes a substantially sideways U-shaped mounting member 19 and a tightening screw 20 threadingly engaged with a screw hole formed in a lower plate of the mounting member 19 as shown in FIG. 1. The tightening screw 20 has an upper end provided with a pressing member 21 and a lower end provided with a grip 22. The grip 22 is turned so as to be tightened while the work table T is interposed between the upper plate of the mounting member 19 and the pressing member 21, whereby the setting frame 11 is fixed to the work table T. The mounting member 19 has a front formed with four screw holes 19*a* as shown in FIG. 4.

The supporting member 16 is formed into the shape of a disc having a slightly smaller diameter than the base plate 14. The supporting member 16 has a rearwardly convex concentric annular protrusion 23 which is formed so as to correspond to the aforesaid protrusion 17. The supporting member 16 further has a circular rearwardly convex portion 16*a* located inside the annular protrusion 23. The circular convex portion 16*a* has four screwing holes 16*b*. The circular convex portion 16*a* has an outer circumference which is fitted into a fitting hole 25*a*. Thus, the supporting member 16 is disposed so that a rotating disc 25 is interposed between the base plate 14 and the supporting member 16 from the front and rear sides respectively. Four screws (not shown) are inserted through the screwing holes 16*b* and 14*a* in turn respectively while a front plate portion of the mounting member 19 of the fixing mechanism 15 has been disposed at the rear side of the base plate 14, whereby the screws are tightened into the screw holes 19*a* respectively. As the result of screw fastening, the supporting member 16, the base plate 14 and the mounting member 19 are connected to one another.

The pivot frame 13 includes the rotating disc 25 located at the rear end side, a cylindrical mount 26 secured to an outer circumferential edge of the front of the disc 25 and a holding cylindrical portion 27 attached to a front of the mount 26. The mount 26 is provided with a flange 28 which receives the rear end of the cap frame body 41 of the cap frame 10 as will be described in detail later. The mount 26 is further provided with two engaging members 29 located at right and left sides of the flange 28 respectively as shown in FIGS. 1 to 3. Each engaging member 29 includes a leaf spring 29*a* having a proximal end secured to the mount 26 and an engagement roller 29*b* rotatably mounted on a distal end of the leaf spring 29*a*. The engaging members 29 are eliminated in FIG. 4 for the sake of simplicity.

The cylindrical portion 27 is provided for receiving the inside of the cloth of the cap C when the cap frame 10 is attached to the setting frame 11. A front half of the mount 26 includes a lower part formed with a notch 27*a* which is rectangular in a planar view, as shown in FIG. 2. The cylindrical portion 27 has a distal end including an upper part formed with a positioning V-shaped notch 27*b* so as to positionally correspond to the central front of the cap C as shown in FIGS. 2 to 4. As a result, the cap frame 10 can be positioned while the operator confirms the notch 27*b* by his or her fingers from above the cap C.

The disc 25 has a central fitting hole 25*a* and is formed into the shape of a ring as shown in FIG. 4. The rotating disc 25 has a front surface having two protrusions 30 and another protrusion 31 all of which are formed substantially at intervals of 120 degrees so as to receive the outer circumference of the supporting member 16. The protrusions 30 located at the lower right and left portions respectively are formed by raising the portions respectively. On the other hand, the upper protrusion 31 is mounted, as an individual member, on the front surface of the rotating disc 25 so that a vertical or radial position thereof is adjustable. The rotating disc 25 is disposed so as to be interposed between the supporting member 16 and the base plate 14 in the front-rear direction. In this case, the outer circumference of the convex portion 16*a* is slidably engaged with the fitting hole 25*a*, and the protrusions 30 and 31 slidably receive the outer circumference of the supporting member 16. Furthermore, the annular protrusion 23 of the supporting member 16 is brought into sliding contact with the front surface of the rotating disc 25, and the annular protrusion 17 of the base plate 14 is brought into sliding contact with the rear surface of the rotating disc 25. As a result, the rotating disc 25 and accordingly the pivot frame 13 are supported on the base frame 12 so as to be coaxially rotatable about the central axis O.

The rotating disc 25 has a pair of crank-shaped grips 32 and 33 which are formed integrally with the disc 25 so as to be located at right and left sides of the disc 25 respectively as shown in FIGS. 1 to 4. The grips 32 and 33 protrude in the right-left direction or in the radial direction and are bent so as to be located in front of the front surface of the rotating disc 25. The disc 25 is provided with an operating member 34 which is located so as to correspond to the grip 33. The operating member 34 locks the pivot frame 13 selectively at a plurality of positions (four positions, for example) in the rotational direction of the base frame 12. The operating member 34 is made of, for example, a leaf spring into the shape of a crank and has a left end divided into three parts. Two of the three parts which are upper and lower parts respectively are screwed to the front of the rotating disc 25 thereby to be fixed in position. The other or central part of the leaf spring is bent rearward thereby to serve as a locking piece 35 which protrudes through the opening 25*b* of the rotating disc 25 to the rear surface side. The operating member 34 includes a middle portion which extends rightward through the notch 26*a* formed in the mount 26. The operating member 34 further has a right distal end serving as a release operation portion 36. The grip 33 includes a frontwardly bent part formed with an opening (not shown) through which the middle portion of the operating member 34 is to extend rightward.

In this case, each of FIGS. 2 to 4 shows a normal state where no external force is applied to the operating member 34. In this state, the locking piece 35 is biased so as to protrude rearward by the spring force of the operating member 34, whereby the locking piece 35 can lock one of the four locking holes 18, as shown in FIGS. 2 to 4. As a result, the pivot frame 13 can selectively be locked to one of the four locking holes 18 formed in the base frame 12 at intervals of 90 degrees in the rotational direction of the base frame 12. The release operation portion 36 is pulled frontward against the spring force thereof although not shown in detail. With this releasing operation, the locking piece 35 is displaced frontward thereby to be released from the locking to the locking hole 18. Thus, the operator can pivotally move the pivot frame 13 relative to the base frame 12 while the locking piece 35 is temporarily pulled out of the locking hole 18. In this case, the operation for releasing the locking piece 35 from the locking to the locking hole 18 can be executed by pinching the front surface of the grip 33 and rear surface of the release operation portion 36 by operator's right hand fingers.

The cap frame 10 will now be described in detail with reference to FIGS. 5 to 8. The cap C is put onto the cap frame 10 from the front thereof while a front with a visor Ca is directed upward. The cap frame 10 is of a non-frame type. More specifically, the cap frame 10 includes a cap frame body 41, a cap support 42 receiving an inner surface of opening side end of the cap C, a pressing member 43 pressing an outer surface of the cap C, a visor support 44 supporting the visor Ca and a retaining frame 45 which fixes the cap C.

The cap frame body 41 is detachably attached to the setting frame 11 or the feed mechanism of the embroidery sewing machine. The cap frame body 41 is formed into an annular shape (or a thin cylindrical shape) and is fitted with the outer circumference of the mount 26. The cap frame body 41 has an outer circumferential surface having a flange 46 which is formed integrally therewith and located slightly rearward. The flange 46 is formed so as to protrude radially outward from the cap frame body 41 and has a function of increasing the rigidity of the cap frame body 41 or preventing the pressing member 43 occupying a pressing position from being displaced. The flange 46 extends over an entire circumference of the cap frame body 41 except for a lower part of the cap frame body 41 as shown in FIG. 7. The flange 46 has a pair of lugs 47 and 48 formed integrally on opposite portions thereof or more specifically, on side portions thereof located a little near an upper portion thereof. The lugs 47 and 48 protrude in the same direction as the flange 46 protrudes. In this case, the lugs 47 and 48 extend in the right-left direction in the flange 46 so as to be opposed to the grips 32 and 33 of the pivot frame 13 respectively.

The flange 46 has a left lower end provided with a pivot shaft 50 supporting a proximal end of the pressing member 43 as shown in FIG. 7. The flange 46 also has a right lower end, and a locking portion 51 is provided near the right lower end of the flange 46 which locks the distal end of the pressing member 43. The left lower end of the flange 46 is formed into a semicircular portion 46*a* protruding radially outward. The pressing member 43 is pivotally mounted on a central portion of the semicircular portion 46*a* by a setscrew 50*a* and a nut 50*b* both constituting the pivot shaft 50. The setscrew 50*a* has a head located at the front and is disposed so as to extend through the proximal end of the pressing member 43 right in front of the semicircular portion 46*a*. The setscrew 50*a* is provided with a retaining ring 52 located between the head of the setscrew 50*a* and the pressing member 43. Furthermore, the setscrew 50*a* is provided with a washer 53 located between the pressing member 43 and the semicircular portion 46*a*. The head of the setscrew 50*a* has a tool groove 50*c* which turns a tool (not shown). Accordingly, the setscrew 50*a* can be pivotally moved from the front by the tool.

Figure 6:
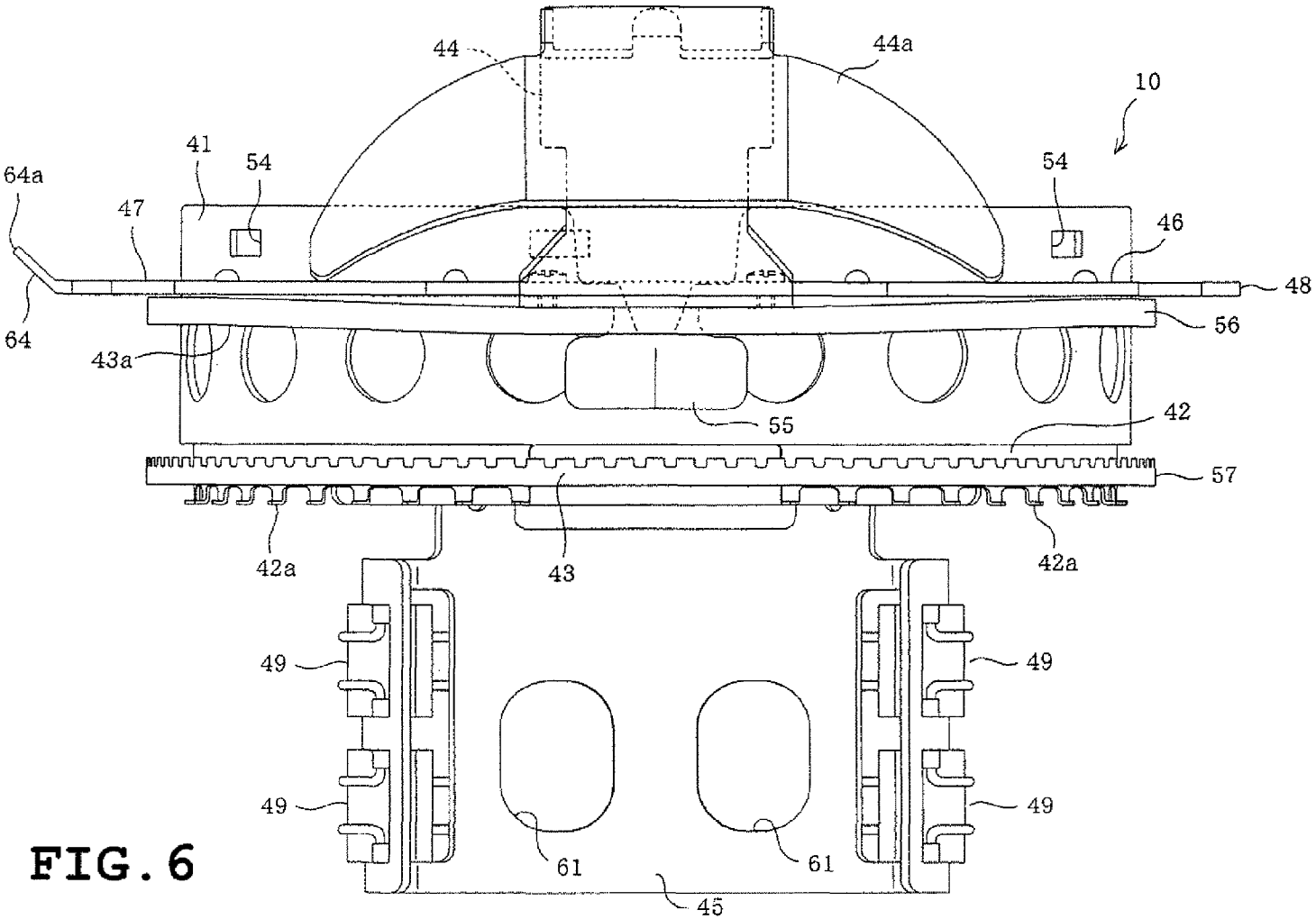
FIG. 6 is a plan view of the cap frame.

The cap frame body 41 has a rear end formed with a pair of right and left engagement holes 54 as shown in FIGS. 5, 6 and the like. The engagement roller 29*b* is engaged with an engagement hole 54 while the inner circumferential surface of the cap frame body 41 is fitted with the outer circumferential surface of the mount 26. The engagement of the roller 29*b* with the hole 54 holds the cap frame in a positioned state in the front-rear and circumferential directions of the pivot frame 13. Furthermore, the cap frame body 41 has an upper end provided with a holding member 55 located in front of the visor support 44. The cap C has a sweat band (not shown) which is normally folded to the inner circumferential side.

The holding member 55 holds the sweat band in an open state. The visor support 44 is provided so as to rise obliquely upwardly rearward from the central upper end of the flange 46. The visor support 44 has an upper end provided with a visor fixing member 44*a* which nips and fixes a distal end of the visor Ca of the cap C.

The cap support 42 has a number of claws 42*a* which are formed integrally with the front end of the cap frame body 41 and arranged in the circumferential direction. The cap support 42 has an outer circumference on which an interlining (not shown) is wound when the cap C is set. The interlining is made of unwoven cloth. In this case, the claws 42*a* are thrust into the interlining thereby to lock the interlining.

The pressing member 43 is made of spring steel as the elastic material, for example. The pressing member 43 is configured into the shape of a narrow frame with an arc curve. More specifically, the pressing member 43 has a rear frame plate 56 and a front frame plate 57 both constituting the frame-shaped portion and a proximal end plate 58 and a distal end plate 59 both located at the proximal and distal end sides of the frame plates 56 and 57 respectively, as shown in FIGS. 5 and 7. The four plates 56 to 59 are connected with one another by connecting members such as screws 60 thereby to be formed into the pressing member 43. The proximal end side plate 58 has an end provided with a mounted portion 58*a* which is pivotally mounted on the pivot shaft 50. The distal end side plate 59 is provided with a hook member 59*a* which is unlockably locked by the locking portion 51. The pressing member 43 has such a front-rear dimension or width as to be fitted between the flange 46 and the front end of the cap support 42. A frame inside 43*a* which is an inner region defined by the front and rear frame plates 57 and 56 serves as a through hole through which the visor Ca is inserted, as shown in FIGS. 5 and 6. The frame plates 57 and 56 have elongate holes 57*a* and 56*a* through which screws 60 are inserted, respectively, as shown in FIG. 5. Accordingly, when the screws 60 are loosened, the positions of the frame plates 57 and 56 can be adjusted relative to the proximal end plate 58. The pressing member 43 is pivotally moved to a position where the pressing member 43 is located along the outer circumference of the cap frame body 41, so that the hook member 59*a* is locked by the locking portion 51. As a result, the vicinity of the cap's part on which embroidery is to be sewn is nipped with the pressing member 43 and the claw 42*a* of the cap support 42 thereby to be held.

The retaining frame 45 is a retaining plate which extends frontward from a lower end of the cap frame body 41 and has a rectangular shape as viewed in a planar view, as shown in FIG. 6. The retaining frame 45 has right and left sides to which the cloth of the cap C stretched tight is attached by pinching the cloth by a plurality of clips 49 from outside. In the embodiment, four clips 49 are used to hold the cap C. The retaining frame 45 has a pair of right and left locking holes 61 formed in a front part thereof. Each locking hole 61 is formed into a generally oval shape. The locking holes 61 are formed so as to face the notch 27*a* of the cylindrical mount 26 when the cap frame 10 has been attached to the setting frame 11, as shown in FIG. 3. The aforesaid interlining has such a width as to extend from the cap support 42 over the cylindrical portion 27 and such a length as to cover an entire length of the cylindrical portion 27. The interlining is locked by the claw 42*a* of the cap frame body 41 when to be set onto the outer circumferences of the cap support 42 and cylindrical portion 27. Furthermore, both lengthwise ends of the interlining are pushed through the respective engagement holes 61 into the inside by fingers. As a result, both ends of the interlining can be held particularly by the locking holes 61 so as not to be disengaged from the outer circumference of the cylindrical portion 27.

The pressing member 43 pivots so as to be switchable between a pressing position where the pressing member 43 presses the part of the cap C to be embroidered or a vicinity of the part and an open position where the pressing member 43 allows the cap C to be attached to or detached from the cap frame 10. Furthermore, the cap frame body 41 is provided with a guide member which guides the pressing member 43 so that the pressing member 43 is prevented from being caught on another member when the pressing member 43 is to be switched between the pressing and open positions.

Figure 8:
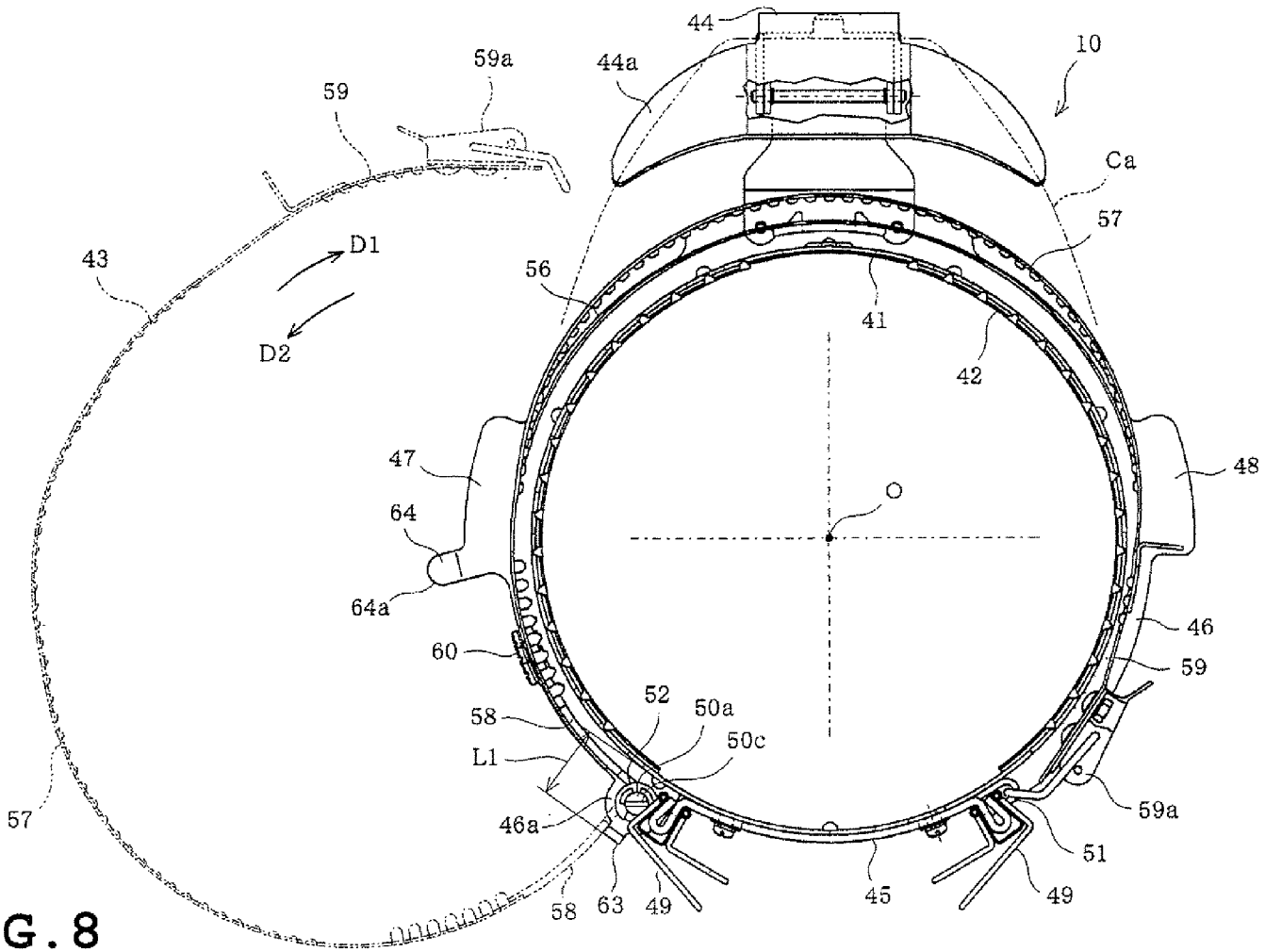
FIG. 8 illustrates the relationship between an open position of a pressing member and a limiting member.

The following will describe the guide member and a limiting member which limits the pivotal movement of the pressing member 43 at the open position. Referring to FIGS. 5 and 8, the flange 46 has a left lower end with which an abutment 63 is formed integrally so as to project outward from the outer edge of the semicircular portion 46*a*. The abutment 63 is formed into the shape of a band and extends radially outward in the radial direction of the cap frame body 41 in the semicircular portion 46*a* (leftwardly obliquely downward, as viewed in FIG. 8). The band-shaped portion is bent forward 90 degrees in the middle thereof into an L-shape, thereby abutting the proximal end plate 58 of the pressing member 43 from below. While being in abutment with the abutment 63, the pressing member 43 is disengaged leftward from the outer circumference of the cap frame body 41 thereby to take a C-shape as shown in by two-dot chain line in FIG. 8. In this case, the distal end plate 59 which is a distal end of the pressing member 43 is located leftwardly obliquely upward above the cap frame body 41. Thus, the abutment 63 functions as a limiting member which abuts the pressing member 43 at the open position to limit the movement of the pressing member 43. Furthermore, as the result of limitation, the pressing member 43 is located at a predetermined position where the distal end plate 59 is easy to hold. The abutment 63 is located near the proximal end of the pressing member 43. Reference symbol "L1" in FIG. 8 designates a dimension of projection from the outer circumference of the cap frame body 41 and the distal end of the abutment 63 as viewed in a front view. The projection dimension L1 can be set to be as short as possible as the result of the above-described manner of locating the pressing member 43 and the abutment 63.

The left lug 47 has an inclined portion 64 formed integrally therewith so as to be located on an outer edge thereof as shown in FIGS. 5 to 7. The inclined portion 64 is formed into the shape of a band and extends radially outward (generally leftward as viewed in FIG. 7) from the lower end of the lug 47. The inclined portion 64 is bent midway so as to be inclined rearward and has an arc-shaped portion 64*a* formed by notching a corner of a distal end thereof. The pressing member 43 can be smoothly guided by the inclined portion 64 without being caught on another member of the cap frame body 41. For example, the pressing member 43 is pivotally moved in the direction of arrow D1 from the open position to the pressing position side as shown in FIG. 7. In this case, the inclined portion 64 extends so that the pressing member 43 and the cap frame body 41 firstly overlap. More specifically, a projection dimension L2 of the inclined portion 64 is set so that the pressing member 43 overlaps the arc-shaped portion 64*a* back and forth earlier than another member inclusive of the flange 46 at the cap frame body 41 side. The projection dimension L2 refers to a length of the inclined portion 64 from the outer circumference of the cap frame body 41 to the distal end of the arc-shaped portion 64*a* as viewed in a front view. The inclined portion 64 is thus constituted into the guide member that is inclined relative to a projecting direction of the flange 28 in such a direction that the pressing member 43 is guided to the pressing position side.

The cap frame 10 constructed above will work as follows. When setting the cap C to the cap frame 10, the operator firstly fixes the setting frame 11 to a predetermined work table T using the fixing mechanism 15 as shown in FIGS. 1 and 2. In this case, the lugs 33 and 32 of the setting frame 11 are located at right and left positions respectively. This state refers to a normal state where the locking piece 35 of the operating member 34 is locked in the right locking hole 18 of the base plate 14.

Subsequently, the operator holds the cap frame 10 with his/her hands, fitting the cap frame 10 onto the outer circumference of the pivot frame 13 of the setting frame 11 in the direction of arrow Yb from before. At this time, the cap frame body 41 is fitted with the outer circumference of the mount 26 of the pivot frame 13 thereby to abut the flange 28, as shown in FIG. 3. Furthermore, the engagement rollers 29*b* of the engagement members 29 are engaged with the two engagement holes 54 of the cap frame body 41 respectively. As a result, the cap frame 10 is attached to the setting frame 11. The operator can grip the lugs 47 and 48 with his/her fingers when the cap frame body 41 is to be fitted with the mount 26. As a result, force can more easily be applied to the lugs 47 and 48 and the cap frame can be mounted more easily accordingly. Additionally, the cap frame 10 can also be detached using the lugs 47 and 48.

The operator then locates the pressing member 43 at the open position and renders the visor fixing member 44*a* and the like open. The operator then sets the interlining and the cap C onto the outer circumferences of the cap support 42 and the cylindrical portion 27 in turn. In the setting of the cap C, the cap C is aligned with the cap frame 10 so that the visor Ca of the cap C is directed upward, as shown in FIG. 8. The operator then holds the distal end plate 59 of the pressing member 43 located at a predetermined position so that the pressing member 43 is pivotally moved in the direction of arrow D1 in FIGS. 7 and 8, so that the pressing member 43 is switched from the open position to the pressing position. Even if the pressing member 43 is displaced in the front-rear direction during the switching, the pressing member 43 contacts the inclined portion 64 thereby to be slid along the inclined portion 64. More specifically, even if flexed in a direction differing from the direction D1 in which the cap C is pressed, the pressing member 43 is guided by the inclined portion 64 to the side of the pressing position right in front of the flange 28. Thus, the distal end of the pressing member 43 occupies a predetermined position when the pressing member 43 is located at the open position, and the pressing member 43 can be prevented from being caught on another member at the cap frame body 41 side during the switching thereof. Consequently, the consecutive work of pressing the cap C by the pressing member 43 can be carried out smoothly. A sequence of the pressing work includes inserting the visor Ca through the frame inside 43*a* while the pressing member 43 is pivoting in the direction of arrow D1, and the hook members 59 are locked to the respective locking portions 51.

Subsequently, the flange fixing members 44*a* and the like are closed, and the clips 49 are applied to the retaining frame 45 so that the rear part of the cap C is held by the retaining frame 45. The setting of the cap C to the cap frame 10 is thus completed. The above-described works of attaching the cap frame 10 to the setting frame 11, attaching the cap C to the cap frame 10 and pressing the cap C by the pressing member 43 are executed in the aforementioned normal state. On the other hand, the work of clipping the cloth to the retaining frame 45 by the clips 49 is hard to carry out in the normal state. In this case, however, the working efficiency can be improved when the cap frame 10 is pivotally moved together with the pivot frame 13 relative to the base frame 12 so that the aforementioned clipping work is carried out with the rear of the cap C being directed sideways or upward. More specifically, the pivot frame 13 can pivot 90 or 180 degrees leftward or rightward as viewed at the front relative to the base frame 12. In this case, firstly, the release operation portion 36 of the operating member 34 is pulled frontward so that the locking piece 35 of the operating member 34 is unlocked from the locking hole 18 of the base plate 14. In this state, the operator holds the grips 32 and 33 with his/her hands so that the pivot frame 13 is pivotally moved 90 or 180 degrees in the counterclockwise direction Xa or clockwise direction Xb in FIG. 3. The operator then releases the hands from the grips 32 and 33 when the pivot frame 13 has been pivotally moved 90, 180 or 270 degrees. As a result, the locking piece 35 is locked selectively to one of the locking holes 18 of the base plate 14. The pivot frame 13 and accordingly the cap frame 10 can be positioned at a desired one of the positions spaced at the intervals of 90 degrees.

According to the above-described cap frame 10, the pressing member 43 can be prevented from being caught on another member of the cap frame 10 by the inclined portion 64 serving as the guide member when the cap's part near the portion which is to be embroidered is pressed by the pressing member 43. Accordingly, the pressing member 43 can smoothly be moved from the open position to the pressing position. Furthermore, since the pressing member 43 is switchable between the pressing position and the open position, the working efficiency can be improved.

The inclined portion 64 can prevent the pressing member 43 from being caught on the flange 46 although the flange 46 is adjacent to a location where the flange 46 is easy to catch the pressing member 43 in the cap frame body 41. Furthermore, the flange 46 can impart rigidity to the cap frame body 41 or prevent the pressing member 43 from being displaced, whereupon a beneficial structure from the practical standpoint can be obtained.

Furthermore, the inclined portion 64 inclined in such a direction that the pressing member 43 is guided to be pressing position side is formed integrally with the flange 46. Consequently, the guide member can be rendered cost-effective and the construction of the guide member can be simplified. Furthermore, the pressing member 43 can accurately be guided to the pressing position adjacent to the flange 46.

The flange 46 is provided with the lugs 47 and 48 the operator holds with his/her hands. Accordingly, when the operator attaches the cap frame 10 to the setting frame 11 or the like while holding the lugs 47 and 48 with the hands, the lugs 47 and 48 can serve as handgrips on which the operator puts his/her fingers. Consequently, since force is more easily applied to the lugs 47 and 48 of the cap frame 10, the working efficiency in the attachment of the cap frame can be improved. Furthermore, the pressing member can be guided by the inclined portion so as to be prevented from being caught on another member of the cap frame 10 inclusive of the lugs 47 and 48. Furthermore, the inclined portion 64 can be disposed by using the lug 47.

The pressing member has conventionally been attached round the cap frame body in pressing the cap's part near the portion which is to be embroidered, by the pressing member. In the foregoing embodiment, however, the pressing member 43 is made of the elastic material and formed into the curved shape. The pressing member is pivotally mounted at the proximal end thereof. Consequently, the pressing member 43 can more easily be pivotally moved between the pressing position and the open position.

The movement of the pressing member 43 is limited by the abutment 63 serving as the limiting member so that the distal end thereof is located at the predetermined position. Consequently, the distal end of the pressing member 43 can be held without hanging when the pressing member is located at the open position. This can start the setting of the cap C more smoothly.

The abutment 63 is provided on the flange 46 of the cap frame body 41 and disposed near the proximal end of the pressing member 43. Consequently, the movement of the pressing member 43 can be limited at the proximal end side, and the construction of the limiting member can be rendered simpler and more compact.

Figure 9A:
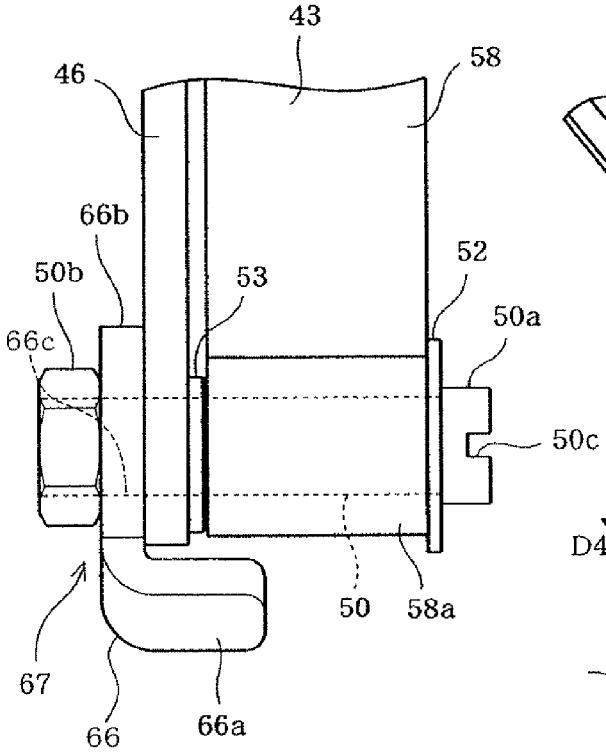
FIGS. 9A and 9B are an enlarged left side view and an enlarged front view of a vicinity of the limiting member according to a second embodiment respectively.
Figure 9B:
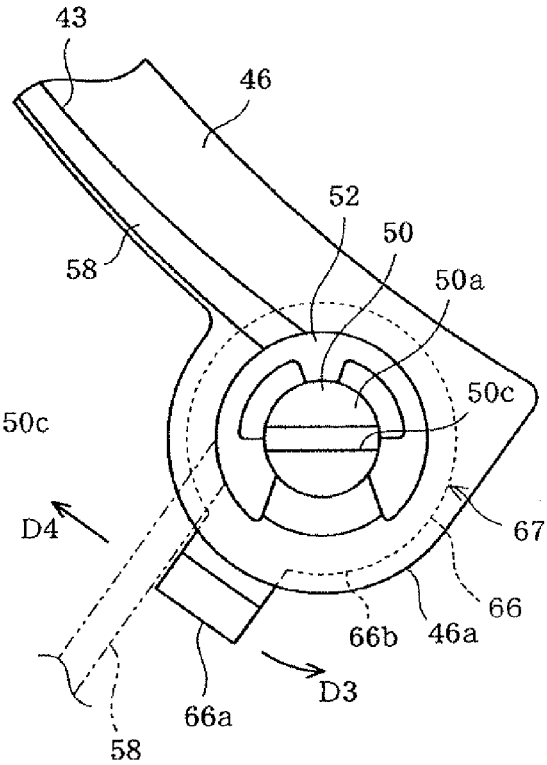

FIGS. 9A and 9B illustrate a second embodiment. Identical or similar parts in the second embodiment are labeled by the same reference symbols as those in the first embodiment, and only the differences of the first and second embodiments will be described.

The cap frame according to the second embodiment includes an abutment 66*a* which differs from the abutment 63 in the first embodiment as follows. The abutment 66*a* is discrete from the semicircular portion 46*a* of the left lower end of the flange 46 but is formed integrally with a part of the circumferential edge of a thin-plate like annular disc 66*b*. The abutment 66*a* and the disc 66*b* constitute an abutting member 66. The disc 66*b* has a through-hole 66*c* through which a setscrew 50*a* is inserted, as shown in FIG. 9A. The disc 66*b* is mounted on the setscrew 50*a* so as to be located between a rear surface of the semicircular portion 66*b* and a nut 50*b* and so as to be pivotable about the setscrew 50*a*. The abutment 66*a* extends outward in a radial direction of the disc 66*b* and is bent frontward at the middle thereof.

The abutting member 66 pivots about the setscrew 50*a* in the direction of arrow D3 or D4 by loosening the setscrew 50*a*. In this case, an abutting position between the proximal end plate 58 as shown in by two-dot chain line in FIG. 9B and the abutment 66*a* is adjusted and thereafter, the abutting member 66 is fixed in position by fastening the same with the setscrew 50*a*. As the result of the adjustment of the abutting position, the distal end of the pressing member 43 located at the open position can be set at a desirable position where the work is easily executable. As a result, the working efficiency can further be improved in the attachment and detachment of the cap to and from the cap frame. This can achieve a simplified structure in which the increase in the number of components is limited as much as possible.

Furthermore, since the setscrew 50*a* is pivotally operable at the front with a tool, the work for adjustment of the aforesaid abutting position can be simplified. The aforesaid abutting member 66, the setscrew 50*a* and the nut 50*b* constitute a limiting member and furthermore, the disc 66*b*, the setscrew 50*a* and the nut 50*b* constitute an adjusting mechanism 67.

The cap frame 10 should not be limited by the foregoing embodiments but may be modified as follows. The guide member may take any form if only the guide member guides the pressing member 43 so that the pressing member 43 is prevented from being caught on another member of the cap frame 10 when the pressing member 43 is switched between the pressing position and the open position. More specifically, the inclined portion 64 may be changed in the mounting position to the cap frame body 41, the shape thereof and the like. For example, a guide member instead of the inclined portion 64 may comprise an individual member discrete from the lug 47 and the flange 46 and may be attached directly to the cap frame body 41.

Although the pressing member 43 is made of the spring steel and formed into the curved shape in the foregoing embodiments, the pressing member 43 may be made of another elastic material. Although the adjusting mechanism 67 comprises the pivot shaft 50 in the foregoing embodiments, a screw other than the setscrew 50*a* may be used. Additionally, various modified forms may be provided regarding the attaching/detaching structure between the cap frame 10 and the pivot frame 13.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A cap frame which includes an annular cap frame body detachably attachable to a feed mechanism of an embroidery sewing machine, the cap frame being configured to hold a cap so that a predetermined part of the cap is embroidered, the cap frame comprising:

a pressing member which has a proximal end mounted on the cap frame body so that the pressing member is pivotally movable thereby to be switchable between a pressing position where the pressing member is configured to press a predetermined part of the cap from outside and an open position where the pressing member allows the cap to be attached to or detached from the cap frame; and a guide member that is configured to guide the pressing member so that the pressing member is prevented from being caught on another member of the cap frame, when the pressing member is switched between the pressing position and the open position, wherein the cap frame body includes a flange which is adjacent to the pressing position and protrudes radially outward from the cap body;

the guide member guides the pressing member so that the pressing member is prevented from being caught on the flange; and the guide member includes an inclined portion which is formed integrally with the flange and is inclined in such a direction that the pressing member is guided to the pressing position side, relative to a protruding direction of the flange.

2. The cap frame according to claim 1, wherein the flange includes a lug that is configured to be held by a user.

3. The cap frame according to claim 1, wherein the pressing member is made of an elastic material so as to be curved and the proximal end of the pressing member is pivotally mounted on the cap frame body.

4. The cap frame according to claim 1, further comprising a limiting member that is configured to limit movement of the pressing member at the open position, wherein the limiting member abuts the pressing member located at the open position thereby to limit the movement of the pressing member so that a distal end of the pressing member is located at a predetermined position.

5. The cap frame according to claim 4, wherein the limiting member includes an abutment which abuts the pressing member located at the open position and an adjusting mechanism configured to adjust an abutting location of the abutment, and the adjusting mechanism is configured to adjust the abutting position of the abutment thereby to set a position of the distal end of the pressing member to a desired position.

6. The cap frame according to claim 4, wherein the limiting member is provided on the flange of the cap frame body and is disposed so as to be located near the distal end of the pressing member.

* * * * *